United States Patent [19]

Allsop et al.

[11] 4,139,210

[45] Feb. 13, 1979

[54] SKI POLE GRIP WITH ELASTIC STRAP

[76] Inventors: Jon I. Allsop, 3157 Sunset Way; James D. Allsop, 2144 Dellesta Dr., both of Bellingham, Wash. 98225

[21] Appl. No.: 798,469

[22] Filed: May 19, 1977

[51] Int. Cl.[2] ..... A63C 11/22

[52] U.S. Cl. ..... 280/11.37 H; 24/169; 24/198

[58] Field of Search ..... 280/11.37 D, 11.37 H; 24/169, 198, 265 R

[56] References Cited

U.S. PATENT DOCUMENTS

| | | | |
|---|---|---|---|
| 3,565,451 | 2/1971 | Giambazi | 280/11.37 H |
| 3,662,433 | 5/1972 | Couttet | 280/11.37 H X |
| 3,825,276 | 7/1974 | Adelmann | 280/11.37 H |
| 4,082,303 | 4/1978 | Finnegan | 280/11.37 H |

*Primary Examiner*—Joseph F. Peters, Jr.
*Assistant Examiner*—Gene A. Church

[57] ABSTRACT

A ski pole grip or handle is provided that includes an elastic strap that can slide through a slot and wherein the strap will stay in place and be released at the proper time. The strap is pliable so that there will be sufficient and proper give and yet the strap can effectively move through its retaining slot when sufficient pressure is applied thereto.

9 Claims, 5 Drawing Figures

Fig-1
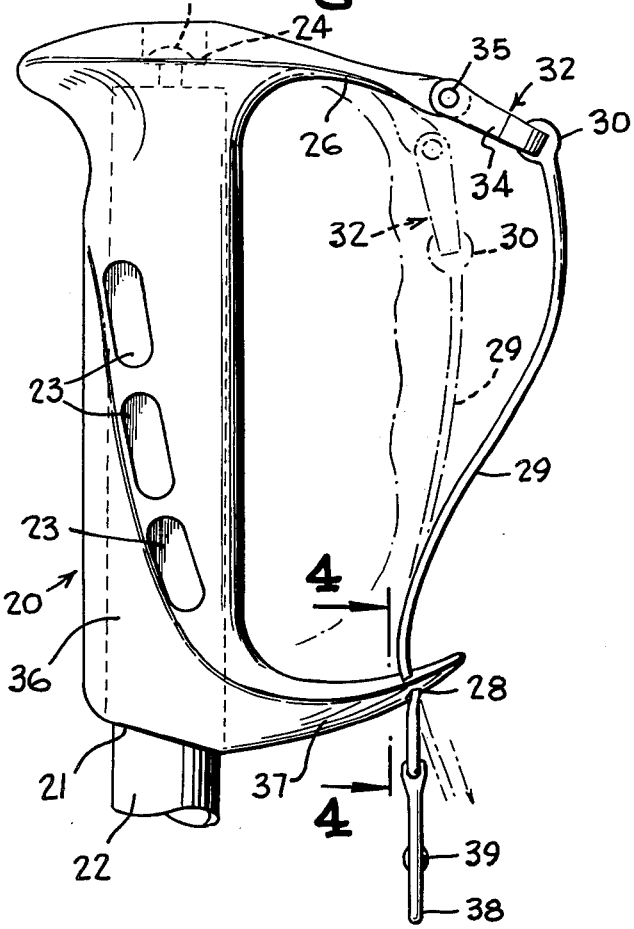
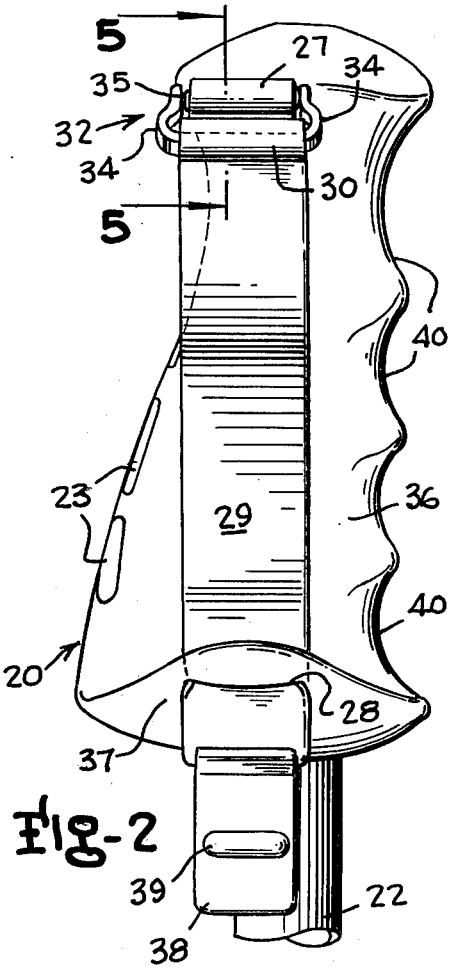
Fig-2
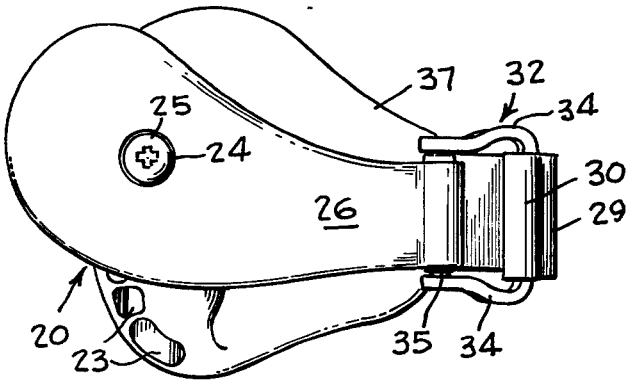
Fig-3
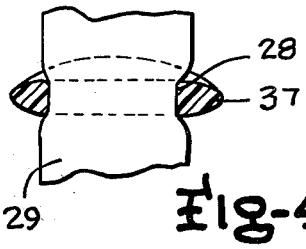
Fig-4
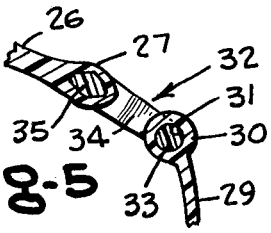
Fig-5

SKI POLE GRIP WITH ELASTIC STRAP

BACKGROUND OF THE INVENTION

Field of the Invention

The present invention relates to a ski pole grip, and more particularly to a ski pole grip that includes an elastic strap that can slide through a slot and yet not be released prematurely. The ski pole grip is extremely easy to get in and out of and has sufficient rigidity or stiffness as compared to fabric straps, so that it provides improved or increased safety and advantages as contrasted or compared to the usual elastic or fabric straps that heretofore have been used in ski pole grips.

SUMMARY OF THE INVENTION

A ski pole grip with an elastic strap is provided and wherein the strap can stretch and slide through a retaining slot under the proper pressure and the advantages of this construction are that it can be pulled tight easily and wherein the strap will be held in the slide due to friction. The elastic strap will stretch when the user desires to get out or be released from the grip. The ski pole grip with the elastic strap of the present invention maintains constant tension on the user's hands because of the elasticity in the strap, and the device permits the hand, as the muscles flex, to work freely while using the ski pole. When griping the pole, the muscles flex and the configuration of the hand changes, but the elastic strap of the present invention maintains the proper or desired amount of tension thereon.

There is further provided other important features such as the use of the elastic strap that slides through a slot and remains in its proper location until a certain amount of pressure is applied and then the strap releases. Further, the elastic strap, as compared to fabric conventional straps, is easy to get in and out of and the present invention provides improved or increased advantages regarding control of the ski pole.

A further important object of the present invention is to provide a ski pole grip with an elastic strap that allows the user to be free when necessary. This is an important safety advantage, and wherein the strap will stretch or slide in the slot under sufficient or proper pressure.

Still another object of the present invention is to provide a ski pole grip with elastic strap that is ruggedly constructed and efficient to use and which is relatively simple and inexpensive to manufacture.

Other objects and advantages of the present invention will become apparent in the following specification when considered in the light of the attached drawings.

BRIEF DESCRIPTION OF THE DRAWINGS

FIG. 1 is a side elevational view illustrating the ski pole grip with elastic strap of the present invention;

FIG. 2 is an edge elevational view taken at right angle to the view shown in FIG. 1;

FIG. 3 is a top plan view thereof;

FIG. 4 is a sectional view taken on the line 4—4 of FIG. 1; and

FIG. 5 is a sectional view taken on the lines 5—5 of FIG. 2.

DESCRIPTION OF THE PREFERRED EMBODIMENTS

Referring in detail to the drawings, the numeral 20 indicates a ski pole grip made of a suitable plastic or elastomeric material and the grip 20 is in the form of a handle or body portion 36 that includes a vertically disposed recess or opening 21 that snuggly receives therein the upper end of a ski pole 22. The handle 36 is provided with recessed portions or slots 23, FIG. 1, and there is provided in the upper end of the grip 20 a countersunk recess 24 for receiving a securing element such as a bolt or screw 25 for maintaining the parts in their proper assembled position.

Formed integral with the upper end of the handle 36 is a projecting portion 26 that has an opening 27 in its outer end, FIG. 5.

Formed integral with the lower end of the handle 36 is a projecting section 37 that has a slot 28 therein, and the slot 28 is arranged in the outer end portion of the section 37. The strap 29 is made of elastic or elastomeric material and the strap 29 has a width so that it snuggly engages or passes through the slot 28. The upper end of the elastic strap 29 is provided with an enlargement or bushing 30 that has an opening 31 therein, FIG. 5.

A bracket 32 has a first section 33 extending through the opening 31, and the bracket 32 further includes a pair of spaced apart side sections 34. A pin portion 35 extends between the side sections 34, and the pin 35 extends through the opening 27 as shown in FIG. 5, so as to provide a swivel connection between the upper end of the strap 29 and the projecting portion 26.

Formed integral with the lower end of the strap 29 or secured thereto is a tongue or enlargement 38 that has ribs 39 thereon, and the tongue 38 provides a convenient manual gripping surface whereby the strap 29 can be adjusted in the slot 28. In addition, the construction of the tongue 38 with the enlargements 39 helps prevent the strap 29 from being inadvertently pulled all the way through in an upward direction through the slot 28.

The handle 36 is provided with recessed portions 40, FIG. 2, so that the fingers of the user's hands can conveniently engage or grip these portions 40. As shown in FIG. 1, due to the swivel connection, including the pin 35 and the fact that the parts are made of elastomeric material such as a suitable plastic, the strap 29 can move from the solid line position of FIG. 1 to the broken line position of FIG. 1 or vice versa, so that the hand of the user will be safely, comfortably, and securely arranged in place on the ski pole grip of the present invention.

From the foregoing, it will be seen that there has been provided a ski pole with an elastic strap, and in use with the parts arranged as shown in the drawing, the grip or handle 20 is mounted on the ski pole 22 and the parts are maintained in their assembled position by means of the screw member 25. The elastic strap 29 is extended through the slot 28 in the projecting portion 37, and the upper end of the strap 29 has the bushing 30 thereon which receives the portion 33 of the bracket 32. The pin portion 35 of the bracket 32 extends swivelly through the opening 27 in the portion 26 so that a certain amount of flexibility is assured for the ski pole grip. Thus, the parts can flex from a position such as that shown in solid lines in FIG. 1 to a position such as that shown in broken lines in FIG. 1, due to the fact that the parts are made of elastomeric material.

The handle 36 and portions 26 and 37 are made of or molded from a single piece of plastic or elastomeric material, and the handle 36 is shaped or has a configuration so as to provide a comfortable and convenient grip for the hands of the user.

The width and thickness of the strap 29 is such that it will be snuggly received in the slot 28 in the portion 37. However, by applying sufficient pressure to a portion such as the portion 38, the strap 29 can be adjusted or tightened to the desired position. In addition, in the event of a fall or in the event that an obstacle is encountered, the strap 29 will work free from this slot 28 to permit the user's hands to be released from the ski pole grip.

It is to be understood that the parts can be made of any suitable material and in different shapes or sizes as desired or required.

Some of the advantages and features of the ski pole side band strap of the present invention are as follows. There is provided improved control of the pole because the hand is held securely to the grip with constant tension. The hand is allowed freedom to expand and work during normal skiing with security and yet the hand is held without restriction including the tuck. The hand is permitted to pull out of the grip safely in case the pole is caught by a double failsafe method because the strap can stretch inasmuch as it is elastic. Secondly, the strap can slip in the slot when the tension is sufficiently great.

The ski pole side band strap of the present invention also allows ease of entry because the strap is slightly stiff which holds it open, and it is very easy to tighten by just pulling on the end of the strap until you have the correct tension. Further, there is very easy egress by twisting the hand which moves the heel of the hand away from the grip to increase tension until the strap slips in the slot 28 and puts the strap in the open position ready for reentry.

The material for making the strap is important and unique because it has a high coefficient of friction, and this is constant with the temperature. Also, the strap material is elastic, and the elasticity is constant with temperature.

The present invention gives improved performance and control as well as more effecient balance. An important aspect or feature of the present invention is the plastic strap that stretches and slides through the slot and in addition, the strap can be pulled through the slot when necessary. The strap is held in place by friction. The strap will stretch the proper amount and yet keep constant tension on the skier's hand because of the elasticity in the strap. The elastic strap slides through the slot and releases if necessary. The device is extremely easy to get in and out of and is relatively stiff and has important advantages and features as compared to fabric, leather or cloth straps such as those used on prior patents. The device is safe to use and provides improved control of the ski pole.

The handle is adapted to be made very temperature stable of a synthetic-resin material and the handle and strap have sufficient elasticity or resiliency to permit the skier to use the device with the aforementioned advantages. Thus, the strap and associated parts have a generally pliable construction so that the skiier obtains the necessary holding action with the proper amount of safety.

It will now be clear that there is provided a device which accomplishes the objectives heretofore set forth. While the invention has been disclosed in its preferred form, it is to be understood that the specific embodiment thereof as described and illustrated herein is not to be considered in a limited sense as there may be other forms or modifications of the invention which should also be construed to come within the scope of the appended claims.

What is claimed is:

1. In a ski pole grip, a handle having a ski pole connected thereto, a projecting portion integral with the upper end of said handle, there being an opening in the outer end of said upper projecting portion, a projecting section integral with the lower end of said handle and arranged in spaced-apart relation with respect to said projecting portion, said projecting section having a slightly curved formation and being provided with a slot in its outer end, an elastic strap having a bushing on its upper end, and said bushing having an opening therein, a bracket having a first section extending through the opening in said bushing, said bracket further including spaced-apart side sections, a pin member extending through the opening in the upper projecting portion and said pin member being connected to the side sections of said bracket, said pin member providing a swivel connection between the strap and the upper projecting portion of the handle, said strap having a width and thickness so that it is snuggly mounted and received in the slot in the lower projecting section on the handle.

2. The structure as defined in claim 1 and further including a tongue portion on the lower end of said strap, and enlarged ribs on said tongue portion.

3. The structure as defined in claim 2 wherein the strap can stretch and slide through the slot, and wherein the strap is held in place by friction.

4. The structure as defined in claim 3 wherein ease of egress is assured for the hand of the skiier as the strap can slip in the slot and put the strap in open position ready for reentry.

5. The structure as defined in claim 3 wherein the strap is made of elastomeric material having a high coefficient of friction that remains constant with the temperature, and wherein the elasticity and coefficient friction of the strap remains constant under fluctuations and variations of temperature.

6. A ski pole handle grip adapted to be mounted to an upper end of a ski pole, said grip comprising:

a. a handle portion, said handle portion comprising:
   (1) a main body portion having an upper end, a lower end, and a middle portion, said middle portion being shaped to be easily grasped in a person's hand,
   (2) a lower projecting section having an inner end and an outer end, said inner end being fixedly connected to the lower end of the body portion, said lower projecting section extending laterally outwardly from the main body portion, and being shaped and positioned to engage a lower portion of the hand of the person grasping said body portion,
   (3) the outer end of the projecting section being formed with a vertically aligned through slot having a predetermined cross sectional configuration, b. an elongate elastic retaining strap, said strap having:
   (1) an upper end connected to the upper end of the main body portion,
   (2) a lower end adapted to extend downwardly through said slot, said strap having a cross sectional configuration such as to fit in said slot with a snug friction fit, said strap being sufficiently elastic so that it can be moved through said slot by stretching said strap in either a generally upward or downward direction, whereby said strap is able to provide lateral resistance to the hand when the strap is in a use position where it is pulled downwardly to snugly engage said hand, and said strap can be loosened from its use position by an upward twisting movement of the person's hand to cause the strap to slide upwardly through said slot.

7. The handle grip as recited in claim 6, wherein said strap has its lower end an enlargement to provide a convenient manual gripping surface by which the strap can be pulled downwardly through said slot.

8. The hand grip as recited in claim 6, wherein said handle is provided with an upper projecting portion extending generally laterally from the upper end of said main body portion, said upper projecting portion being connected to the upper end of said strap and being capable of being deflected downwardly by a downward pull of said strap, whereby said strap is able to be moved downwardly and inwardly against said hand, and upwardly and outwardly away from said hand.

9. The handle grip as recited in claim 6, wherein:

a. said strap has at its lower end an enlargement to provide a convenient manual gripping surface by which the strap can be pulled downwardly through said slot, and b. said handle is provided with an upper projecting portion extending generally laterally from the upper end of said main body portion, said upper projecting portions being connected to the upper end of said strap and being capable of being deflected downwardly by a downward pull of said strap, whereby said strap is able to be moved downwardly and inwardly against said hand, and upwardly and outwardly away from said hand.

* * * * *